US007972257B2

(12) United States Patent
Pistner

(10) Patent No.: US 7,972,257 B2
(45) Date of Patent: Jul. 5, 2011

(54) ARTICLE FORMING PAPER WRAPPING DEVICE

(75) Inventor: Donald W. Pistner, St. Marys, PA (US)

(73) Assignee: St. Marys Box Company, Inc., St. Marys, PA (US)

( * ) Notice: Subject to any disclaimer, the term of this patent is extended or adjusted under 35 U.S.C. 154(b) by 0 days.

(21) Appl. No.: 12/930,431

(22) Filed: Jan. 6, 2011

(65) Prior Publication Data

US 2011/0111937 A1 May 12, 2011

Related U.S. Application Data

(62) Division of application No. 11/810,740, filed on Jun. 7, 2007, now Pat. No. 7,887,474.

(51) Int. Cl.
*B31F 1/00* (2006.01)

(52) U.S. Cl. ..... 493/462; 493/460; 493/454; 493/13; 493/964; 242/160.1

(58) Field of Classification Search ..... 493/394, 493/269, 299, 460, 461, 462, 454, 10, 13, 493/964; 242/610.1, 613.3, 613.4, 362, 362.2, 242/362.3, 160.1, 571, 573.4
See application file for complete search history.

(56) References Cited

U.S. PATENT DOCUMENTS

| | | | | |
|---|---|---|---|---|
| 1,401,123 A | | 12/1921 | Anderson | |
| 1,608,331 A | * | 11/1926 | McElwain | 242/160.1 |
| 2,423,533 A | | 1/1947 | Turner | |
| 2,493,562 A | * | 1/1950 | Yarman | 108/51.3 |
| 2,614,588 A | | 11/1952 | Laycock | |
| 3,513,053 A | | 5/1970 | Sullivan | |
| 3,732,790 A | * | 5/1973 | Miyake et al. | 493/278 |
| 3,853,670 A | | 12/1974 | Cox et al. | |
| 3,890,190 A | | 6/1975 | Eburn, Jr. | |
| 4,109,040 A | * | 8/1978 | Ottaviano | 428/129 |
| 4,701,155 A | | 10/1987 | Ott | |
| 4,952,202 A | * | 8/1990 | Itoh | 493/299 |
| 4,958,819 A | * | 9/1990 | Jung | 270/30.03 |
| 5,205,807 A | | 4/1993 | Adams, Jr. et al. | |
| 5,232,429 A | * | 8/1993 | Cizek et al. | 493/299 |
| 5,385,625 A | | 1/1995 | LaFreniere | |
| 5,448,956 A | * | 9/1995 | Ong et al. | 108/51.3 |
| 5,472,540 A | * | 12/1995 | Marschke et al. | 156/184 |
| 5,569,148 A | | 10/1996 | LaFreniere et al. | |

(Continued)

FOREIGN PATENT DOCUMENTS

DE 19529573 A1 2/1997

(Continued)

*Primary Examiner* — Paul R Durand
(74) *Attorney, Agent, or Firm* — Hudak, Shunk & Farine Co. LPA

(57) ABSTRACT

A device for processing sheets, rolls or the like, preferably sheets or rolls of corrugated paper, into useful articles. More specifically, the invention relates to a paper wrapping device that can convert a sheet or strip of paper into a useful article comprising a plurality of wrapped paper layers, suitable for use as a support member or a pallet stringer. Also the invention provides a device that contains a conveying unit which transfers a material, such as paper, to a forming unit which produces a core layer and further wraps additional layers in a clockwise or counterclockwise direction around said core in one or more layers to form a support member having a solid wrap of continuous layers.

14 Claims, 4 Drawing Sheets

U.S. PATENT DOCUMENTS

| | | | | |
|---|---|---|---|---|
| 5,916,079 | A | 6/1999 | Haring et al. | |
| 6,612,247 | B1 | 9/2003 | Pistner et al. | |
| 6,669,129 | B1 | 12/2003 | Shah | |
| 6,676,061 | B1 * | 1/2004 | Cain | 242/401 |
| 6,736,074 | B2 * | 5/2004 | Pistner et al. | 108/51.3 |
| 2004/0023770 | A1 | 2/2004 | Tisma | |

FOREIGN PATENT DOCUMENTS

| | | |
|---|---|---|
| WO | WO 96/38291 | 12/1996 |
| WO | WO 02/02413 | 1/2002 |

* cited by examiner

ARTICLE FORMING PAPER WRAPPING DEVICE

CROSS REFERENCE

This application is a divisional application of U.S. patent application Ser. No. 11/810,740, filed Jun. 7, 2007 now U.S. Pat. No. 7,887,474 for ARTICLE FORMING PAPER WRAPPING DEVICE, herein fully incorporated by reference.

FIELD OF THE INVENTION

The present invention relates to a device for processing sheets, rolls or the like, preferably sheets or rolls of corrugated paper into useful articles. More specifically, the invention relates to a paper wrapping device that can convert a sheet or strip of paper into a useful elongated article comprising a plurality of wound, wrapped paper layers, suitable for use as a support member or a pallet stringer.

BACKGROUND OF THE INVENTION

Industries such as transportation and manufacturing have for years utilized wood articles such as logs, boards, and planking as supports, braces, and separators for various goods or other materials. While wood articles have been known to be durable, they have numerous drawbacks.

Disadvantages include that wood is relatively dense and thus heavy. The weight of wood articles increases transportation costs and reduces the amount of materials which can be transported. A further disadvantage is that wood surfaces are rough and generally uneven which can damage the finish of materials, especially fragile materials, abutted or supported thereby. Moreover, when exposed to moisture, wood articles can warp, becoming unlevel and not suitable for intended uses.

A pallet is a portable platform generally including a planar horizontal member, which can be used as a base member for stacking, storing, handling and transporting materials or goods and generally two or more spacers, stringers, support members, or the like that maintain the base member a distance off of the ground so that they can be moved more easily. Generally, pallets are constructed from wood and nails or staples. Pallets have also been constructed from paper-based materials and plastics. Pallets generally have openings in the structure thereof to accommodate the forks of a forklift truck, or the like, and allow the pallet to be lifted off a floor.

Various methods, constructions and devices have been proposed as means for producing components such as for use in pallets and as wood replacement articles.

U.S. Pat. No. 6,736,074 relates to a lightweight support member or article prepared from corrugated paper which is utilized as a replacement for wood articles such as logs, boards, planks and the like. The support members have a high strength to weight ratio and save on transportation and fuel costs. The support members are constructed as a continuous or semi-continuous, flattened or elongated wind of corrugated paper around a core or central area.

U.S. Pat. No. 6,612,247 relates to a lightweight pallet, which can be manufactured from corrugated paper or similar materials which are recyclable, for carrying goods and materials. The pallet includes an upper deck member, lower deck member and a plurality of support members connected therebetween. The deck members are independently disposed at a horizontal plane substantially parallel to each other as well as a ground surface. The support members are formed from a continuous wind of a single sheet of corrugated paper to provide strength and rigidity to the pallet.

U.S. Pat. No. 5,569,148 relates to an apparatus for forming a pallet spacer from a one-piece blank, the one piece blank having at least a first end and a second end, a retention segment disposed between the first and second ends, the retention segment defining a retention aperture, the second end including a cut-out flange having a hinge, the apparatus comprising a base, a rotating mandrel assembly mounted on the base for wrapping the one-piece blank around itself such that the retention aperture is registered directly adjacent the cut-out flange, the rotating mandrel assembly including a selective engagement means for gripping the first end of the one-piece blank when the one-piece blank is wrapped around itself, a punch for pushing the cut-out flange into the retention aperture thereby retaining the one-piece blank in a coiled shape forming a pallet spacer and a stripper for removing the pallet spacer from the rotating mandrel assembly.

U.S. Pat. No. 5,385,625 relates to an apparatus for manufacturing corrugated pallets from a base panel of corrugated material, a top panel of corrugated material and a plurality of spacer blocks. Each of the spacer blocks is bonded to the base sheet and top sheet. The apparatus comprises a loading station for receiving the base panel and top panel, and a glue applicator for extruding a plurality of continuous sheets of glue to predetermined areas of the base panel and top panel. An assembly station includes a locating system for receiving and locating the base panels, spacer blocks and top panel in relation to the base panel when the top panel is placed upon a plurality of spacer blocks to form the corrugated pallet. A transfer compression station for applying a continuous initial pressure to the corrugated pallet at the base and top panels of the corrugated pallet while simultaneously transferring the corrugated pallet in a horizontal direction is provided, as well as a final compression station for applying a final glue setting pressure to the corrugated pallet. A conveyor for transferring the base and top panels from the loading station through the glue applicator is provided, wherein the conveyor also transfers the base and top panels from the glue applicator to the assembly station. The compression conveyor transfers the corrugated pallet from the assembly station to the final compression station.

U.S. Pat. No. 3,853,670 relates to a machine for manufacturing disposable recyclable pallets and comprises a machine framework adapted for supporting a stack of pallet sheets composed of a recyclable material and for supporting a plurality of stacks of pallet blocks which may be composed of wood or other recyclable material. The machine also includes an adhesive system providing adhesive material that is utilized to secure the pallet blocks in assembly with the pallet sheets. The machine incorporates a mechanism for transporting pallet sheets one at a time to a pallet assembly section defined by the framework. The pallet blocks, after being conveyed through the adhesive system for application of adhesive to the upper surface thereof, are positioned by a conveyor mechanism beneath and spaced in relation to the pallet sheet. A mechanism is then manipulated to move the pallet sheet downwardly into assembly with the pallet blocks and to apply sufficient mechanical pressure to the assembly for a predetermined period of time to allow curing of the adhesive material. The pallets manufactured by the machine may have a single pallet sheet or may have double pallet sheets sandwiched about the pallet blocks and may be adjustable to manufacture pallets of differing size.

U.S. Pat. No. 3,513,053 relates to an apparatus and method for making pallets of composite construction, with a plastic polymeric core and outer elements of fibrous sheet material such as corrugated board. The apparatus comprises a conveyor, hopper means for feeding the core to the conveyer, means associated with the conveyor for applying adhesive to the core, severing means associated with the conveyor for dividing the core into a plurality of discrete core elements, moving support means for supporting sheet elements and conveying the elements to a location adjacent the conveyor, transport means for engaging the discrete core elements and transporting the elements in predetermined relation to each other to a sheet element on the conveyor, and means associated with the conveyor for transporting another sheet element into vertical juxtaposition with the discrete core elements and the first-mentioned sheet elements and placing the sheet elements over the discrete elements in contact with the respective faces of the discrete elements. The method comprises the steps of providing a core of plastic polymeric material having a plurality of interconnected discrete segments, severing the core to disconnect the segments, applying adhesive to the respective opposite faces of the segments, spacing the segments by a predetermined distance, placing the segments in spaced relation on a sheet element of predetermined dimensions, and placing a second sheet member of predetermined dimensions in contact with opposite faces of the discrete segments.

In order to produce support members, such as disclosed in the above-noted U.S. Pat. Nos. 6,736,074 and 6,612,247 herein fully incorporated by reference, it would be desirable to provide an automated device capable of rapidly producing high quality support members via mass production in order to lower the cost associated with preparing such a support member. The problem of mass producing support members with repeatable, accurate dimensions is solved by the paper wrapping device of the present invention.

SUMMARY OF THE INVENTION

A paper wrapping device is disclosed that is useful to form articles from paper, such as corrugated paper. A preferred article is an elongated, wound support member that can be utilized for a substitute for wood articles, such as logs, boards, planks and the like. The support members can also be utilized as supports or stringers of pallets.

The wrapping device includes a conveying unit that receives a preferably continuous sheet or strip of paper to be wrapped or wound from a paper source such as a roll of paper. The conveying unit transfers the paper utilizing a feed controller to regulate paper flow, orientation, etc., to a forming unit through a bonding agent application device which selectively applies an adhesive to desired portions of the paper prior to winding by the forming unit. The forming unit includes at least a pair of winding arms and the paper is wound around the winding arms which are rotated about an axis until a desired number of wrapped layers are achieved around the core layer to form a support member. The support member is removed from the winding arms and paper source, and transferred by a transfer station to a press unit where the support members are clamped to a desired pressure in order to set or solidify the support member adhesive.

Accordingly, it is an object of the present invention to provide a device that can be utilized to form an elongated support member having a plurality of windings, rapidly, and efficiently.

A further object of the invention is to provide a device that contains a conveying unit which transfers a material, such as paper, preferably corrugated paper, to a forming unit which produces a core and further wraps additional layers in a clockwise or counterclockwise direction around said core in one or more layers to form a support member having a solid wrap of contiguous layers.

In one aspect of the invention, a paper wrapping device for producing an elongated support member having a plurality of wrapped layers is disclosed, comprising a conveying unit adapted to receive paper from a paper source, the conveying unit comprising a feed controller that controls orientation of paper received from the paper source utilizing a sensor, and adjusts the orientation if the sensor determines the paper is out of alignment; and a forming unit for wrapping the paper into a support member and located downstream from the conveying unit and operatively receiving paper from the conveying unit for winding the paper into a support member, the forming unit comprising a first winding arm, a second winding arm, and a clamp assembly, each rotatable about an axis of rotation, the clamp assembly including a clamp movable in relation to and engagable with one of the winding arms to hold a portion of the paper between the clamp and the winding arm during at least a portion of the winding process.

In a second aspect of the invention, a sheet material wrapping device for producing an elongated support member having a plurality of wrapped layers is disclosed, comprising a forming unit having winding arms operatively connected to a rotatable shaft of a motor, wherein the winding arms are each rotatable about a rotational axis and adapted to wind a sheet material from a sheet source into a support member having one or more wrapped layers, wherein the forming unit comprises a clamp assembly including a clamp operatively movable in relation to and engagable with one of the winding arms to hold a portion of the sheet material between the clamp and the winding arm during at least a portion of rotation of the winding arms; an end cutting device comprising a cutting member adapted to cut the sheet material at an angle from 0° to about 45° measured with respect to a direction perpendicular to a feed direction of the sheet material; and a holding member device including a holding member that is adapted to contact the sheet material during a cutting operation, and wherein the holding member device directs an end portion of the sheet material between one of the winding arms and clamp after a cutting operation has been performed.

In a third aspect of the invention, a paper wrapping device for producing an elongated support member having a plurality of wrapped layers is disclosed, comprising a forming unit comprising a motor having a rotatable shaft, wherein a length adjustment member is connected to the rotatable shaft, wherein a first winding arm is connected to the length adjustment member and a second winding arm is connected to the rotatable shaft or length adjustment member, wherein the first and second winding arms are rotatable about a rotational axis and adapted to wind paper from a paper source into a support member having one or more wrapped layers, wherein the forming unit further comprises a clamp assembly including a clamp operatively movable in relation to and engagable with one of the winding arms to hold a portion of the paper between the clamp and the winding arm during at least a portion of rotation of the winding arms, and wherein the forming unit motor is connected to a winding arm carriage and is movable substantially laterally with respect to a feed direction of the paper and capable of separating contact between the support member and the winding arms after a support member has been formed.

BRIEF DESCRIPTION OF THE DRAWINGS

The invention will be better understood and other features and advantages will become apparent by reading the detailed description of the invention, taken together with the drawings, wherein.

DETAILED DESCRIPTION OF THE INVENTION

Figure 1:
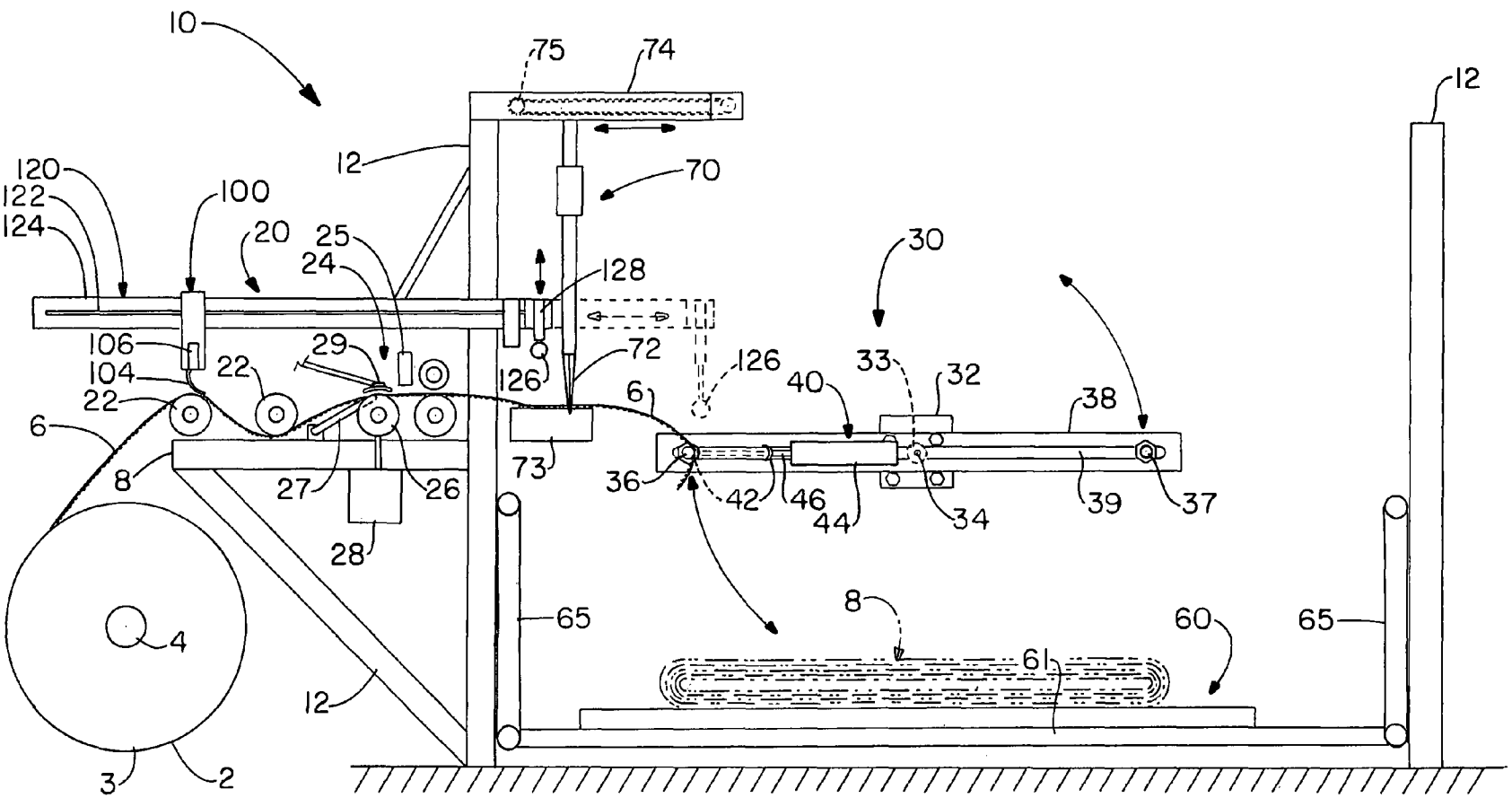
FIG. 1 is a cross-sectional side elevational view of one embodiment of a portion of a paper wrapping device of the present invention, comprising a conveying unit, a forming unit, an end cutting device and a transfer station.

This description of preferred embodiments is to be read in connection with the accompanying drawings, which are part of the entire written description of this invention. In the description, corresponding reference numbers are used throughout to identify the same or functionally similar elements. Relative terms such as "horizontal", "vertical", "up", "down", "top" and "bottom" as well as derivatives thereof (e.g., "horizontally", "downwardly", "upwardly", etc.) should be construed to refer to the orientation as then described or as shown in the drawing figure under discussion. These relative terms are for convenience of description and are not intended to require a particular orientation unless specifically stated as such. Terms including "inwardly" versus "outwardly", "longitudinal" versus "lateral" and the like are to be interpreted relative to one another or relative to an axis of elongation, or an axis or center of rotation or a portion of the device, as appropriate. Terms concerning attachments, couplings and the like, such as "connected" and "interconnected", refer to a relationship wherein structures are secured or attached to one another either directly or indirectly through intervening structures, as well as both movable or rigid attachments or relationships, unless expressly described otherwise. The term "operatively connected" is such an attachment, coupling or connection that allows the pertinent structures to operate as intended by virtue of that relationship.

The present invention discloses a wrapping device that is utilized to form useful articles from a sheet, strip(s), roll or the like of a sheet material, such as paper, preferably corrugated paper. Preferably a support member is formed from paper, preferably corrugated paper, and can be utilized as a substitute for wood articles such as logs, boards, planks, pallet stringers and the like. The support member is an elongated article comprising a core of the material and a plurality of outer layers wrapped about the core. The support member generally has curved ends, and a length between the ends preferably greater than a width. In a preferred embodiment, a support member fabricated utilizing the device of the present invention is used between two corrugated deck members to form a pallet. The wrapping device can advantageously form a plurality of support members simultaneously as a unitary construct that can be cut into individual support members having a desired or predetermined height.

Sheet materials that can be processed utilizing the device of the present invention include both natural and synthetic materials, or combinations thereof. Generally, any sheet material that is relatively flexible and can be wound or wrapped about two or more axes can be utilized. Suitable sheet materials include, but are not limited to, paper, polymers, copolymers, rubbers and elastomers whether reinforced or not, fibrous materials either woven or nonwoven, with paper being preferred, most preferably corrugated paper. While the detailed description provided herein is specifically described with reference to the processing of paper such as corrugated paper, it is to be understood that the device is not limited thereto.

The wrapping device includes a paper conveying unit that receives paper from a paper source such as a paper roll. The conveying unit prepares the paper for winding transfers the paper to a forming unit. Prior to transfer to the forming unit, the conveying unit preferably conveys the paper past or through a bonding agent application device thereof where a bonding agent is selectively applied to desired portions of the paper prior to winding by the forming unit to substantially adhere adjacent layers of paper upon winding. The forming unit comprises at least two and preferably a pair of winding arms, one of which operatively captures an end portion, i.e., leading edge portion, of the paper received from the conveying unit. The forming unit is activated and the paper is wound around the winding arms which are rotated about an axis until a desired number of wrapped layers are achieved around a core layer to form the support member. The winding arms release their hold on the paper and are laterally withdrawn out of the formed support member, preferably after an end cutting device severs the paper feed from the wound support member. The support member is transferred by a transfer station to a press unit where the support member is clamped at a desired pressure for a desired period of time, preferably until the bonding agent has obtained a sufficient cure or dried sufficiently. The support member can be utilized as is or can be further processed, for example by splitting or cutting the support member preferably perpendicular to the height of the member, such as perpendicular to the longitudinal direction of the flutes when the paper is corrugated paper.

The embodiments of the paper wrapping device and associated components according to the present invention are specifically described, with reference to the drawings, wherein like numerals indicate like corresponding parts throughout the several Figures.

FIG. 1 is a partial side elevational view of one embodiment of the paper wrapping device 10 of the present invention which includes a conveying unit 20 that is adapted to receive paper 6 from a paper source 2, such as a paper roll 3 that can be unwound from paper source roller 4 as needed during the process to produce a support member. In other embodiments, the conveying unit can receive paper directly from a corrugator which forms the corrugated paper in the prior step. Such corrugators are well known to those of ordinary skill in the art. The paper thus has a width, a thickness per layer, and a length, with the length determined by the paper source utilized. Generally, any pliable corrugated paper can be utilized. The conveying unit 20 can be constructed to accept a desired width of paper. For example, in one embodiment, the conveying unit 20 is fabricated to accept paper having a width that ranges generally from about 0.5 inch to about 63 inches and preferably from about 36 inches to about 60 inches. Moreover, generally any thickness of paper can be utilized, such as industry standard corrugated paper having, for example A, B, or C flutes.

Figure 4:
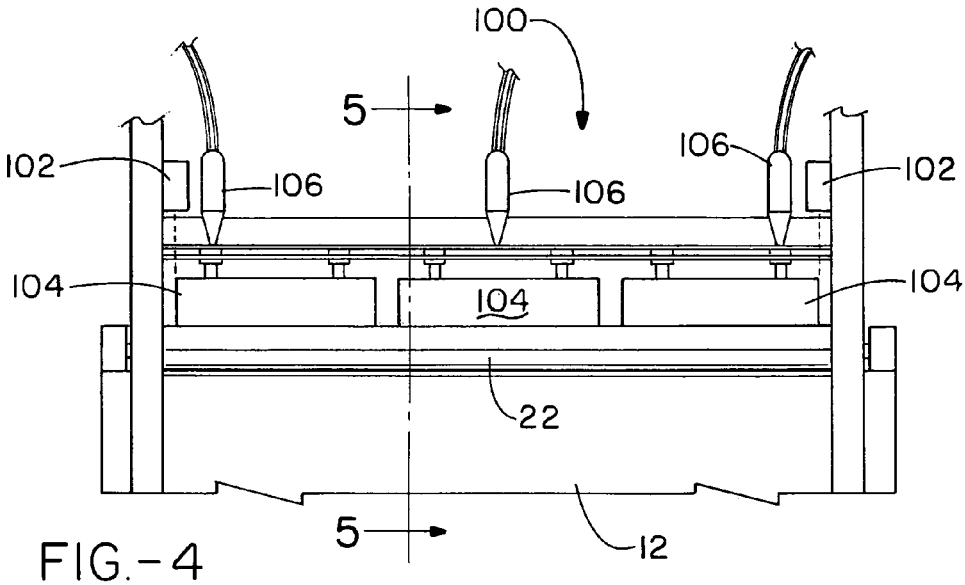
FIG. 4 is a front elevational view illustrating one embodiment of a feed controller of the conveying unit of the paper wrapping device.
Figure 5:
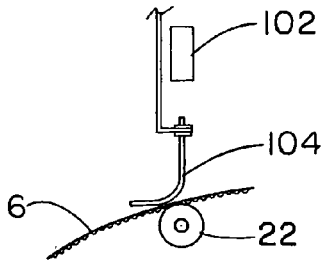
FIG. 5 is a cross-sectional side view through line 5-5 of FIG. 4.

Conveying unit 20 includes a feed controller 100 such as shown on the left side of FIG. 1 that prepares the paper for winding. Feed controller 100 in one embodiment includes one or more sensors 102, such as shown in FIGS. 4 and 5, which interpret the alignment or orientation of the paper with respect to a particular reference point of the device and feed controller 100 can utilize such information to correct misalignment and, therefore, maintain a proper alignment of paper being transferred through feed controller 100. In one embodiment, sensor 102 is a photoelectric sensor, such as a retroreflective sensor as known in the art. Feed controller 100 includes at least one and preferably a plurality of paper feed control members, such as guide rollers 22 rotatably mounted on a shaft fixed to a frame portion of the conveying unit 20 that are configured to accept an appropriate width of paper from the paper source 2 and transfer or guide the same to forming unit 30, further described below. In one embodiment, the rollers have a longitudinal length of about 63 inches (160 cm) and a diameter of about 3.5 inches (8.89 cm).

As illustrated in FIGS. 4 and 5, feed controller 100 includes a roller 22 and a plurality of tension plates 104 disposed in close proximity to roller 22, preferably above as shown, that are adapted to aid in alignment of the paper as it is fed through paper wrapping device 10. One or more activators 106, preferably air activated, are utilized to selectively apply pressure to one or more tension plates 104 at one or more portions along the width of the paper being fed between tension plate 104 and rollers 22 in order to align the paper. Sensor 102 is adjustable and able to be utilized with paper having various widths. FIG. 4 illustrates three tension plates 104 that are hingedly connected to a frame of feed controller 100. Preferably at least one activator 106 is connected to a center or central tension plate 104 so that constant pressure is applied, such as by utilizing air pressure from activator 106 which applies a downward force on tension plate 104, urging the tension plate 104 toward roller 22. If paper being conveyed through feed controller 100 tracks to the right or to the left, for example, pressure is selectively applied to one of the outer tension plates 104, i.e., either the right plate or left plate, by activator 106 in order to restore desired alignment to the paper. The feed controller 100 thus provides a system for actively correcting and optimizing the directional, orientational feed of the paper into the device 10.

The feed controller 100 guides the paper to a bonding agent applicator device 24 that can selectively apply a bonding agent to a portion of paper 6 as it passes by, through, or past the applicator device 24. As illustrated in FIG. 1, paper 6 passes between tension plate 104 and roller 22, and then additionally under additional roller 22 and subsequently to the bonding agent applicator device 24. At least one roller 22 is motor driven. The speed of the rollers can increase or decrease by the speed of the paper traveling over them. An encoder can be utilized in one embodiment to sense the paper speed. Rollers 22 of the feed controller 100 generally do not drive the paper, but insure smooth, guided movement of the paper to the forming unit 30. Paper feed and speed is generally controlled by the rotation of winding arms 36 as described hereinbelow. After exiting applicator device 24, the paper is preferably transferred between an additional set of guide rollers 22, such as illustrated in FIG. 1 prior to being transferred to the forming unit. Rollers 22 preferably rotate about a horizontal axis. Paper 6 rests on an upper surface of the lower roller 22 situated below the paper when paper 6 is not actively being fed to the forming unit 30.

Any suitable bonding agent can be utilized in applicator device 24. Typically, water soluble bonding agents are utilized. Examples of suitable bonding agents include, but are not limited to, water-based adhesives, rubber-based adhesives, and acrylic-based adhesives. A preferred adhesive is a polyvinyl acetate emulsion available from Pioneer Adhesive Products of America Corporation, Orchard Park, N.Y. The bonding agent is maintained in the bonding agent supply 28 until needed for application to paper 6.

Bonding agent applicator device 24 includes an applicator 26 such as a roller, pad, or the like, with a roller being preferred. The applicator 26 can have a smooth surface or a porous surface, such as a fabric, pad or the like that can aid in application of glue to paper, into contact therewith. In a preferred embodiment, applicator 26 is a roller, such as a 5 inch diameter roller having a metal, such as aluminum, surface, with the roller formed of a plurality of segments having recesses or spaces therebetween. Bonding agent supply 28 in a preferred embodiment includes a pump that is utilized to deliver a desired amount of the bonding agent to a reservoir operatively connected to applicator 26 thereby allowing the amount of the bonding agent applied to paper 6 to be adjusted as desired in order to obtain a strong bond between adjacent layers or portions of layers of the support member to be formed as desired.

Applicator 26 preferably includes a plurality of axial recesses or gaps which provide a housing for one or more, and preferably a plurality of lifters 27, when it is desired that the paper passing over applicator 26 is to be coated with the bonding agent. Lifters 27 have an end portion operatively connected to device 10 such that upon activation, a second portion of the lifters 27 emerge from the recess or housing within applicator 26, i.e. between rollers, etc., thereby preventing contact of paper 6 with applicator 26. In a preferred embodiment, a first end portion of a lifter 27 is hingedly connected to a portion of frame 12 of device 10. The lifter body extends to a location within a recess of applicator 26 and does not contact paper 6 in an inactive position or interfere with the function of applicator 26. In a preferred embodiment, the one or more lifters 27 are operatively controlled by an air cylinder which is controlled by an encoder and programmable logic controller of the device 10. The encoder tells the programmable logic controller the length of paper that has passed by a predetermined point and thus activates the air cylinder as necessary to activate or inactivate lifters 27. Generally, when the lifters 27 are activated, the second end of the lifter 27 within the recess of applicator 26 moves upward and contacts paper 6, and the paper 6 rides along an upper edge of lifter 27 above the applicator surface and directly between subsequent rollers 22, preferably at the beginning of a winding step so that the leading edge of paper 6 is not coated to prevent adhesive buildup on winding arms 36, 37. A tension arm 29 such as shown in FIG. 1 is preferably included in the bonding agent applicator device 24 in order to exert a desired pressure on paper 6 in order to maintain contact with applicator 26 to enhance adhesive application to the paper. In one embodiment, it is desirable to not apply a bonding agent to a first leading end portion of paper 6 that is transferred to forming unit 30 in order to prevent adherence of or build-up of bonding agent, or the like, on portions of the forming unit such as a winding arm thereof. Thus, in one embodiment the first end portion of the paper is free of a bonding agent until such time as it may be contacted by another layer including an adhesive. Applicator device 24 can apply adhesive to one or both sides of paper 6 as desired, although it is preferable in some embodiments to only apply bonding agents to a single side of paper 6.

In yet a further optional embodiment of the present invention, the bonding agent application device 24 includes a coating device 25 such as illustrated in FIG. 1, which is utilized to apply an adhesive to an upper surface of paper 6. The function of the coating device 25 is controlled by the encoder and programmable logic controller. Coating device 25 can apply a desired adhesive, for example by spraying, or flood coating, or the like. Coating device 25 can apply a same or different adhesive than applied by applicator 26.

Figure 2:
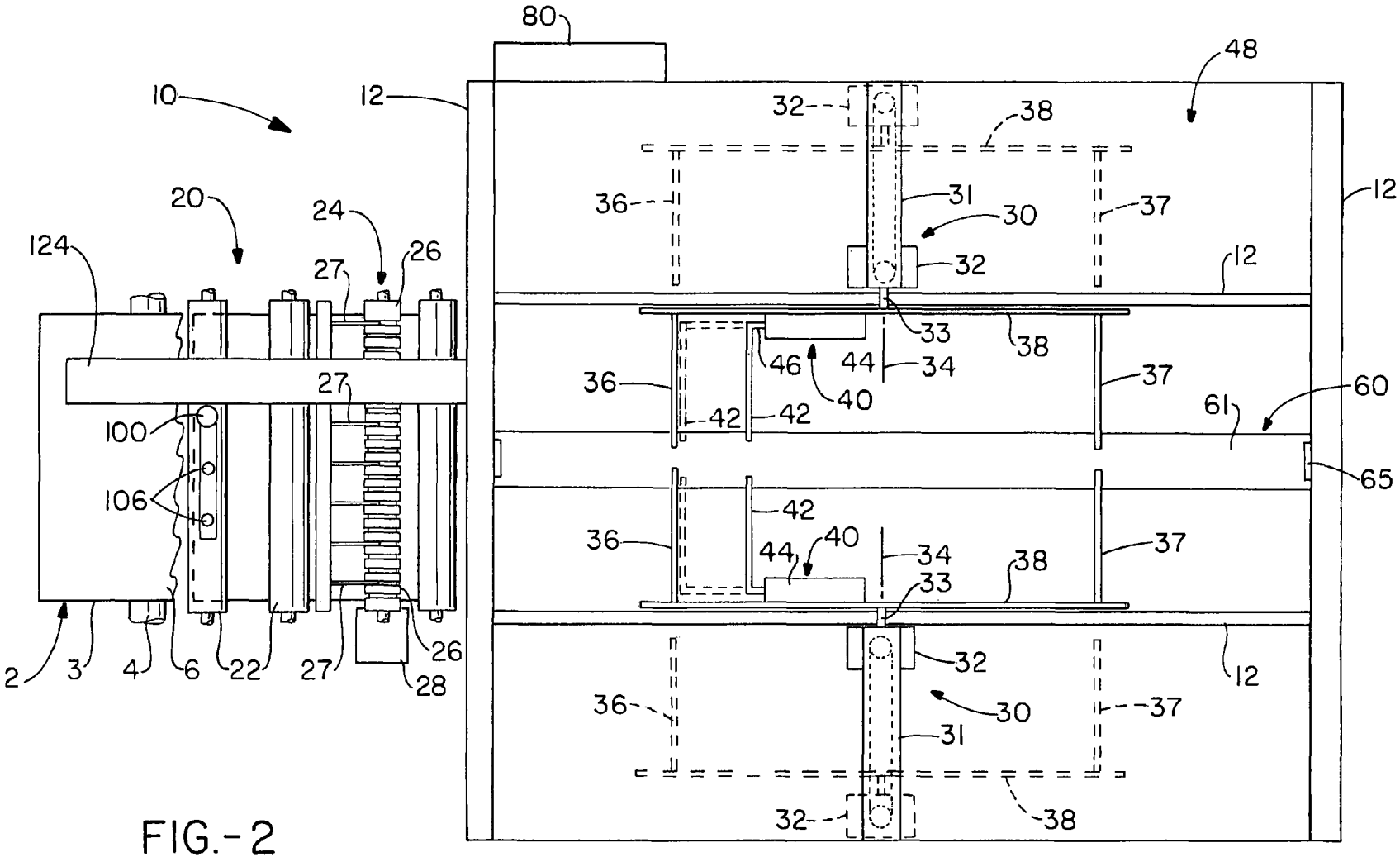
FIG. 2 is a cross-sectional top view of one embodiment of a portion of a paper wrapping device of the present invention including the conveying unit, forming unit, and end cutting device.

Paper 6 is transferred from conveying unit 20 through or past an end cutting device 70, and holding member device 120, both described further hereinbelow, of forming unit 30. Forming unit 30 includes a first winding arm 36 positioned, such as shown in FIG. 1, to receive a free end portion of paper 6. Winding arm 36 is adjustably situated a desired distance from a rotational axis 34 and can rotate thereabout when motor 32 is activated. In a preferred embodiment, the rotational axis 34 is substantially horizontal, and extends through shaft 33 of motor 32. Winding arm 36 is connected to length adjustment member 38 which in turn is connected to rotatable shaft 33 of the motor 32. In one embodiment, the winding arm 36 is a rod having a desired length with a longitudinal axis of the arm being parallel to the rotational axis 34 of the forming unit 30. Longitudinal length of winding arm 36, generally perpendicular to length adjustment member 38, can vary. When a single winding arm is utilized in one embodiment, the length of the winding arm is generally greater than the paper width. When two or more winding arms are utilized such as shown in FIGS. 1 and 2, the length of winding arm should be sufficient such that the paper being processed is adequately supported, without substantial sagging, during the winding process. The distance of winding arm 36 from central axis 34 can be adjusted utilizing adjustment slot 39. Accordingly, support members of different lengths can be produced by simply adjusting the distance of one or both winding arms 36 from the rotational axis. In one embodiment, one of the winding arms is located along the rotational axis, and can be an extension of shaft 33. That said, the distance between two winding arms can vary as desired in order to form a support member of a particular length. For example, length between two winding arms can range generally from about 4 inches (10 cm) to about 96 inches (244 cm), and preferably between about 32 inches (1 cm) to about 72 inches (183 cm). Of course, the number of windings or layers of paper around a first layer or core will also affect the overall longitudinal length of the support member.

The forming unit 30 is provided with a clamp assembly 40, such as shown in FIGS. 1 and 2, that selectively interacts with, contacts, or is operatively connected to winding arm 36 so that the paper can be captured between the winding arm 36 and a clamp 42 of the clamp assembly 40 wound into a support member. Clamp assembly 40 is operatively connected to length adjustment member 38 and co-rotates with winding arm 36 during forming of the support member. Clamp assembly 40 is preferably a pneumatically powered piston assembly, such as a double acting nose mount cylinder, available from Grainger Inc. of Lake Forest, Ill. Clamp assembly piston cylinder 44 is preferably fixed on a portion of the length adjustment member 38 and rod 46 is movable in relation thereto. The travel distance of rod 46 can be varied as desired in order to connect the paper between winding arm 36 and clamp 42. Clamp 42, such as a v-shaped member, arc-shaped member, or other member which is complementary to the shape of winding arm 36 is preferably connected to the distal end of rod 46 opposite piston cylinder 44. Clamp 42 can be any desired length, generally measured perpendicular to length adjustment member 38, and preferably ranges generally from about 5 inches (12.7 cm) to about 24 inches (61 cm), desirably from about 8 inches (20 cm) to about 18 inches (46 cm), and preferably from 10 inches (15 cm) to about 12 inches (30.5 cm).

Interaction of clamp 42 with winding arm 36 is, in one embodiment, as follows. A leading end portion of paper 6 received from conveying unit 20 is positioned over winding arm 36 that is between winding arm 36 and clamp 42 which is in a retracted position, away from arm 36 as shown in FIG. 1. Prior to a first run of the paper wrapping device 10, the paper 6 is preferably routed by hand through conveying unit 20, bonding agent application device 24 such that the leading end portion of paper 6 is in position to be clamped between winding arm 36 and claim 42. Clamp assembly 40 is activated and rod 46 is extended from cylinder 44 and the end portion of paper 6 is operatively held between winding arm 36 and clamp 42 so the winding operation can be performed. Clamp 42 is preferably maintained against rod 36 during the entire winding operation.

With paper 6 connected to forming unit 30, the winding process is started. Motor 32 is activated causing shaft 33 to rotate either clockwise or counter clockwise. The winding arms 36 rotate around rotational axis 34 and layers of paper are wrapped around winding arms 36. A core layer of paper 6 is formed that is substantially linear as the first layer is wound from first winding arm 36 connected to an end portion of paper 6 around the second winding arm 36. The paper 6 is drawn by forming unit 30 a sufficient length during the winding process until the formed support member 8 has a desired number of wrapped layers. A support member can be formed with at least one complete rotation of the winding arms around rotational axis 34. Generally, the winding arm 36 performs from about 1.5 to about 30 rotations or cycles, and preferably from about 3 to about 15 rotations in order to form a support member.

After the desired number of layers are wrapped around the winding arms 36, length adjustment member 38 is stopped at the load/unload position, which is preferably horizontal as shown in FIG. 1, with motor 32 thus deactivated. End cutting device 70, and holding member device 120 as shown in FIG. 1, are moved into position inwardly, generally towards the end of the support member wrapped around winding arm 36, and cutting member 72 cuts or otherwise separates the formed support member from the paper feed. Afterwards, the forming unit 30, including winding arms 36, is removed from the formed support member. Before the winding arm or arms 36 are removed, the clamp 42 is deactivated and moved away from the winding arm, thereby freeing the first end portion of the paper 6 from the winding arm 36 and clamp 42. At this point in this embodiment of the process, the support member is positioned substantially horizontal, i.e. a horizontal line can be drawn through the curved ends. An elevator platform 61 of transfer station 60, which is operatively connected to frame 12 of the wrapping device 10, is raised from a floor of the device so that support member 8 can rest thereupon. Platform 61 preferably includes an arm or other member that contacts the wrap support member 8 thereby holding the support member in place on the platform during cutting of paper 6 to separate the paper feed from the wrapped support member 8. Afterwards, forming unit 30 is moved laterally outward with respect to support member 8 and winding arms 36 are withdrawn from within support member 8 utilizing winding arm carriage 31, which is generally a track or shuttle system, such as shown in FIG. 2. Essentially, winding arms 36 are withdrawn into a winding arm storage area 48 as shown in FIG. 2.

End cutting device 70 includes cutting member shuttle 74 which allows the cutting member 72 to be moved laterally toward and away from the winding arms. In this manner, end cutting device 70 is retracted into the position such as shown in FIG. 1 during winding and thereby preventing any interference with the winding of the support member. A cutting member shuttle 74 in one embodiment includes a controlled chain drive 75 to provide the tracked movement. In a similar manner, holding member device 120 includes a holding member shuttle 122 such as shown in FIG. 1 which includes a drive unit 124 that performs movement of the holding member 126 towards and away from the winding arm 36 and assembly thereof.

Figure 6:
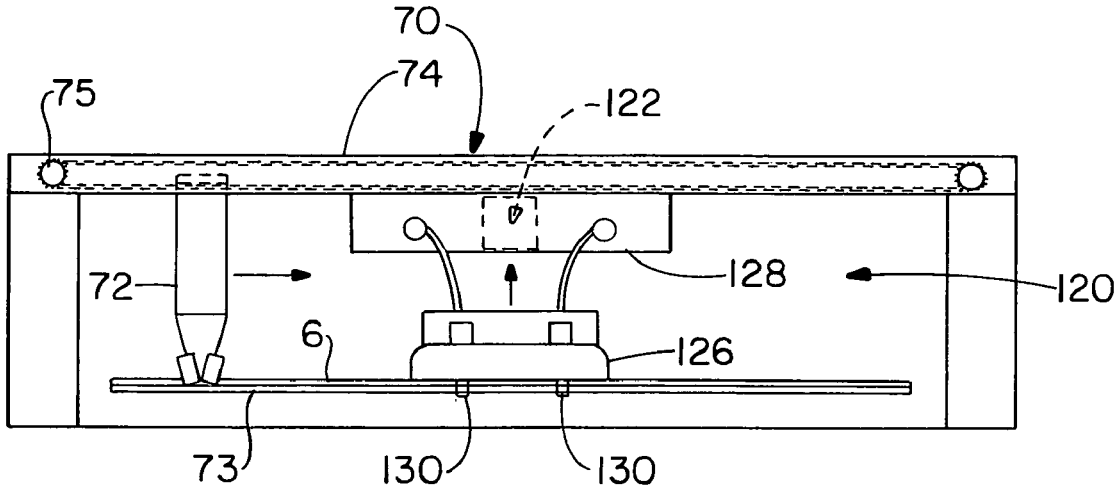
FIG. 6 is a partial elevational view particularly illustrating one embodiment of an end cutting device and a portion of a holding member device of the present invention.

After the desired support member has been formed, the end cutting device 70 and holding member device 120 are activated and moved into an active position adjacent one of the winding arms 36. When extended to a desired active position, holding member 126 of holding member device 120 is lowered into contact with a portion of the paper 6. The paper 6 at this point in the process is held between holding member 126 and cutting bed 73, which is generally a support, such as steel, having a channel therein for cutting member 72. Holding member 126 includes an activatable securing device 130, such as shown in FIG. 6 which fastens, at least temporarily, paper 6 to the holding member 126, wherein the securing device 130 can include one or more prongs, fasteners, or the like, which can in one embodiment, pierce a portion of the paper 6 or otherwise grasp the paper 6. Vacuum holding or the like can be used in some embodiments. With the holding member 126 in place and contacting paper 6, the cutting member 72, which preferably comprises a cutting device or tip such as a knife, blade, or the like, traverses a track and cuts paper 6 thereby cutting, severing the formed support member from the paper feed. The cutting device is preferably removably connected to the cutting member 72 so that replacement is easily facilitated when a blade becomes worn or broken. In a preferred embodiment, cutting member 72 is secured between two members, such as metal plates, to provide stability to the cutting edge. It is desirable in one embodiment to traverse the paper perpendicular to the linear edge of the paper feed, such as shown in FIG. 6. In one embodiment, the cutting member cuts the paper or sheet material at an angle from 0° to about 45° measured with respect to a direction perpendicular to a feed direction of the sheet material or paper. The cutting member 72 generally moves from one side of the device 70 across and through the paper, to the other side of the device 70. With the next cycle, the cutting member 72 makes a return trip in the opposite direction across the next end of the subsequent support member. After the paper has been cut, the holding member 126 is retracted upwards towards the holding member shuttle 122 and the end cutting device 70 is retracted towards the paper inlet area, i.e. towards the conveying unit. The end cutting device 70 is thus positioned out of the way for the next winding cycle. The holding member 126 is lowered via holding member actuator 128 with the newly created end portion of paper being draped over the winding arm 36 and between winding arm 36 and clamp 42. Clamp 42 is activated securing paper between the same and winding arm 36. Holding member 126 and securing device 130 are then released from paper 6 and retracted upwards towards holding member shuttle 122. Shuttle member 122 is retracted out of the way of the winding arms 36 towards conveying unit 20 so that an additional cycle which forms a further support member can begin.

Prior to withdrawal of winding arms 36 from the formed support member, a portion of the transfer station 60, preferably an elevator platform 61, is raised and brought into contact with support member 8. In one embodiment, the transfer station is formed as a lift unit having platform 61 that is height adjustable via a gear unit 65 of station 60. During the winding process, platform 61 is in a retracted position, and situated below the forming unit 30 and out of the way of the rotating winding arms 36, such as shown in FIG. 1.

Figure 3:
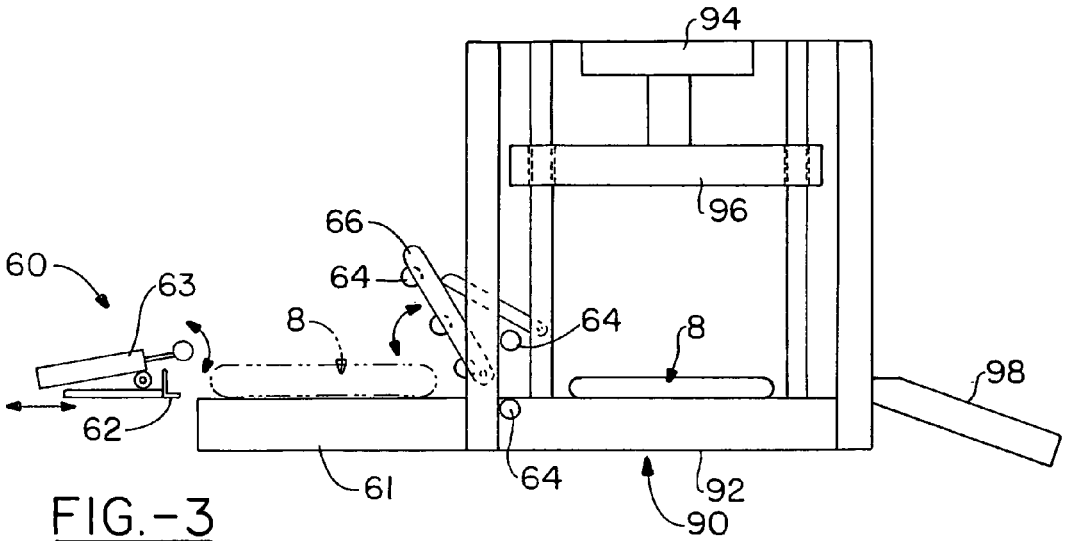
FIG. 3 is a cross-sectional side elevational view of one embodiment of a press unit of the paper wrapping device.

After the winding arms 36 have stopped, preferably in the horizontal position as shown in FIG. 1, platform 61 is raised until contact is made with the formed support member. Afterwards, the winding arms are withdrawn leaving the support member resting on platform 61, the formed support member 8 is cut free from the paper 6 of paper source 4 by end cutting device 70, and platform 61 of transfer station 60 receives the support member from the forming unit 30. Platform 61 is then lowered below the forming unit 30. Transfer station 60 includes a transfer arm 62 generally located adjacent platform 61 opposite press unit 90. Transfer arm 62 includes an end portion adapted to contact an end of the support member on platform 61 when in a lowered position and urge or move the support member towards the press unit 90. Transfer arm 62 is activated, which causes the transfer arm 62 to contact the support member and remove the same from platform 61, thereby sending and delivering the support member to the press unit 90 for finishing. In one embodiment transfer station 60 includes one or more placement arms 63 such as shown in FIG. 3 which, when activated, extend outward and downward and contact an upper surface of the support member during movement of the transfer arm. Placement arms 63 comprise preferably a pneumatically powered piston cylinder hingedly connected to frame 12 and having weighted ends which, after extension outward, are pulled downward by gravity and contact the upper surface of the support member during movement of the transfer arm. Placement arm 63 aids in holding the terminal end of the paper as it travels towards the press unit so the support member does not unwind.

In a preferred embodiment, transfer arm 62 pushes on the end of the support member and horizontally moves the support member into the press unit 90. One or more guides 64, such as rollers, are present at the entrance to press unit 90 for receiving the support member. As the transfer arm pushes the end of the support member, the opposite end comes into contact with the one or more guides 64 which further facilitate movement of the support member into the press unit 90. The support rollers can be motor driven in one embodiment and controlled by the programmable logic controller. As illustrated in FIG. 3, the transfer station 60 in one embodiment includes one or more pressure guides 66 that, when activated from a storage position generally located outside of a chamber of the forming unit 30 to prevent interference with winding of the support member, extend outward into the forming chamber and downward coming to rest upon the upper surface of the support member on platform 61. In a preferred embodiment, a pressure guide 66 contacts the exposed end of paper 6 formed by end cutting device 70, applying pressure thereto, thereby aiding in preventing the end of the paper from being raised off the surface of the support member. Pressure guide 66 preferably includes one or more rollers which contact the support member during use and movement of the support member in the press unit 90. Pressure guide 66 can include one or more nose mounted air cylinders which extend the rollers forward and into contact with the support member.

Press unit 90 includes a base plate 92 onto which the transfer arm 62 conveys support member 8. Press unit 90 further includes a pressure plate 96 generally opposite base plate 92 which is operated by force unit 94. When activated, force unit 94 moves pressure plate 96 downward towards base plate 92, with support member 8 therebetween. A predetermined pressure is then applied to the support member in order to produce a support layer of desired form having the various layers of the winding adhere to one another, where an adhesive has been applied to a surface thereof. In one embodiment, generally from about 50 psi (345 kPa) to about 200 psi (1379 kPa), and preferably from about 80 psi (551.6 kPa) to about 100 psi (689 kPa), is applied to the support member for a predetermined period of time, such as about 40 seconds, until the device is utilized to prepare a subsequent support member which is then transferred into the press unit. After the desired pressing operation has been performed on the support member 8, the support member 8 is transferred to a loading station 98 and a further support member is loaded onto the press unit 90 for a finishing operation, if desired.

Wrapping device 10 of the present invention includes an appropriate control unit or panel 80 for use by an operator. The control panel allows the operator to set, control and optimize substantially all of the operations performed by the wrapping device 10. In one embodiment the control panel includes one or more programmable controllers such as programmable logic controller. A programmable logic controller is generally a collection of digital relays that control the parameters of the components of the paper wrapping device 10 of the present invention. The sensors, actuators, and the like are connected to the programmable logic controller. Generally, the programmable logic controller is adapted to read limit switches, process variables and the positions of the various components or systems present in the device. The programmable logic controller controls operation of the motors, pneumatic or hydraulic cylinders, solenoids, relays, etc. Such programmable logic controllers are known in the art and are available from suppliers such as the Allen-Bradley Company and Eaton Cutler-Hammer. The programmable logic controller includes a user interface that allows for manipulation of various process variables as desired by the end user. In one embodiment the programmable logic controller utilized is an Eaton Cutler-Hammer ELC. Examples of variables that are controlled utilizing the control panel include, but are not limited to, runner width, wrap count, run length, bonding agent volume, and process speed for the various process steps. Moreover, as described herein, the logic controller controls all air values, both pressure and time, various relays, bonding agent application and starting and stopping. The logic controller controls the travel and function of the end cutting device and the holding member device. The number of cycles and support members produced can be tracked, as well as the throughput of paper, and can the logic controller can perform calculations as to how much paper will be utilized to make a single support member based upon the number of winds and length between winding arms.

One method for forming a support member 8 utilizing the wrapping device 10 of the present invention is as follows. Paper 6 from a paper roll 6 is operatively routed through to conveying unit 20. As illustrated in FIG. 1, paper 6 is fed through feed controller 100, under the tracking plates 104 and above roller 22, such as shown in FIG. 5, past bonding agent application device 24, through a set of rollers 22 and an end thereof is transferred to winding arm 36. The end of the paper is placed between the winding arm 36 and clamp 42. Clamp assembly 40 is activated and clamp 42 clamps an end portion of paper 6 between clamp 42 and winding arm 36. Motor 32 is activated and horizontal adjustment member 38 begins to rotate around rotational axis 34. The paper is pulled from roll 3 and wound around winding arms 36 until a desired number of winds have been completed. Bonding agent application device 24 is utilized during the winding process to selectively apply adhesive to one or both sides of the paper 6 as desired.

After the desired winding operation has been performed, the rotation of length adjustment member 38 is ceased and is returned to a position such as shown in FIG. 1 so that the forming unit can be removed from the support member which has been formed thereon. Platform 61 is raised in order to support the formed support member 8. An end cutting device 70 is activated, moved into the forming chamber, and cuts or otherwise severs the paper feed of paper 6 from the formed support member 8, preferably by utilizing a cutting edge of cutting member 72 to traverse a path perpendicular to the paper feed. Holding member device 120 is also activated and moved into the forming chamber preferably simultaneously with end cutting device 70. Holding member 126 is contacted with paper 6, preferably prior to and during paper cutting by end cutting device 70. Securing device 130 is preferably extended through paper 6 in order to securely grasp the same during the cutting operation. Clamp 42 is released from its position against winding arm 36 and forming unit 30 is backed away and out from the support member, with winding arms 36 removed from the inner portion of the support member. End cutting device 70 is returned to its inoperative position. In order to begin the next cycle, holding member 126 is lowered so that the leading edge of paper 6 is extended between winding arm 36 and clamp 42, whereafter clamp 42 is activated, securing leading edge of paper between clamp 42 and winding arm 36. The holding member 26 is released from the paper 6 and returns to the holding member shuttle 122 and holding device 120 is returned to its inoperative position until needed after the next winding cycle. Platform 61 is lowered and transfer arm 62 pushes the formed support member into press unit 90. A predetermined force is then applied to the formed support member for a desired period of time so that the adhesive contacts an adjacent layer of the support member and is dried or cured before the support member is transferred to the unloading station.

In an alternate embodiment, more than one sheet of paper can be fed simultaneously to conveying unit, with a plurality of sheets of paper being operatively connected to the forming unit and thus wound into a support member. However, utilizing a single sheet of paper is preferred.

The corrugated paper utilized to form a support member of the present invention is single wall, double wall, or triple wall, or the like. As known in the art, single wall corrugated sheets are formed from two face sheets, connected by a layer of flutes. Single wall corrugated paper is preferred for use in forming support member utilizing the wrapping device of the present invention. The flutes can be described as having a repeating "S" shaped pattern, sine or nonsine pattern, or wave profile. The height of flutes, i.e., from peak to trough, can vary as known in the art, and can be, but are not limited to, A, B, C and E grade. As described above, the support member is formed of one or more pieces of corrugated paper wound or wrapped in a direction around itself thus having a desired length, and width or thickness.

The size of the paper wrapping device and components thereof determines the size of the support member 8 that can be fabricated therein. As the paper width can vary, a plurality of support members can be formed at a single time. After processing in paper wrapping device 10, the extended width support member can be cut into multiple support members having desired dimensions, for example wherein the cutting operation is performed perpendicular to the longitudinal direction of the flutes. The overall size of the support member can vary with the height ranging generally from about 3 inches (7.62 cm) to about 5 inches (12.7 cm) or about 6 inches (15.24 cm), desirably from about 3.5 inches (8.89 cm) to about 4 inches (10.16 cm), and preferably about 3.5 inches (8.89 cm). The width ranges generally from about 2 inches (5 cm) to about 4 inches (10.16 cm) or about 6 inches (15.24 cm), desirably from about 2 inches (5 cm) to about 3 inches (7.62 cm), and preferably from about 2 inches (5 cm) to about 2.5 inches (6.35 cm). The length ranges generally from about 6 inches (15.24 cm) or about 12 inches (30.5 cm) to about 72 inches (183 cm) and preferably from about 32 inches (81.28 cm) to about 72 inches (183 cm). The method of forming provides support member 8 having a rounded or curved end portion and a core formed from a first layer, and a solid wrap of contiguous layers wrapped in a clockwise or counterclockwise direction around said core and one or more layers forming the support member having a desired length, height and width. Preferably, the support member length is at least twice the support member width.

The support members formed by the present invention are advantageously utilized in pallets such as described in U.S. Pat. No. 6,612,247, as well as U.S. Pat. No. 6,736,074. Moreover, a support member can be utilized as a brace, such as on the floor of a truck, trailer or rail car, or can be used between adjacent items or rows of items. Two or more support members can even be fastened together in order to provide a larger surface area, if desired.

The support member of the present invention has excellent strength. The wrapped structure provides rigidity and stability to the support member. The curved end portion is very stable and aids in preventing separation between the layers. The support member is used wherever bracing, support, or the like are needed. The support member provides cushioning properties and absorbs vibrations which can occur in transit, thereby reducing damage to a product. Moreover, the support member is free of nails, splinters, or other protrusions harmful to products which can be supported thereby. The support members are recyclable and repulpable, thereby reducing waste in landfills.

As described above, the present invention provides a paper wrapping device for manufacturing corrugated support members, in rapid fashion, and can be shaped to fit a specific need.

In accordance with the patent statutes, the best mode and preferred embodiment have been set forth; the scope of the invention is not limited thereto, but rather by the scope of the attached claims.

What is claimed is:

1. A sheet material wrapping device for producing an elongated support member having a plurality of wrapped layers, comprising:

a forming unit having winding arms operatively connected to a rotatable shaft of a motor, wherein the winding arms are each rotatable about a rotational axis and adapted to wind a sheet material from a sheet source into a support member having one or more wrapped layers, wherein the forming unit comprises a clamp assembly including a clamp operatively movable in relation to and engagable with one of the winding arms to hold a portion of the sheet material between the clamp and the winding arm during at least a portion of rotation of the winding arms;

an end cutting device comprising a cutting member adapted to cut the sheet material at an angle from 0° to about 45° measured with respect to a direction perpendicular to a feed direction of the sheet material; and a holding member device including a holding member that is adapted to contact the sheet material during a cutting operation, and wherein the holding member device directs an end portion of the sheet material between one of the winding arms and clamp after a cutting operation has been performed.

2. The sheet material wrapping device according to claim 1, wherein the end cutting device includes a cutting member shuttle that selectively moves the cutting member between an inactive position to prevent interference with a winding cycle of the winding arms and an active position located closer to the winding arms so that the cutting operation can be performed, wherein the holding member device includes a holding member shuttle movable between an inactive position to prevent interference with a winding cycle of the winding arms and an active position located closer to the winding arms wherein the holding member can be connected to the paper.

3. The sheet material wrapping device according to claim 2, wherein a length adjustment member is connected to the rotatable shaft, and wherein the winding arms are operatively connected to the length adjustment member.

4. The sheet material wrapping device according to claim 3, wherein at least one winding arm is connectable to the length adjustment member at a plurality of distances from the motor shaft.

5. The sheet material wrapping device according to claim 4, wherein the forming unit motor is connected to a winding arm carriage and is movable substantially laterally with respect to a feed direction of the sheet material.

6. The sheet material wrapping device according to claim 5, wherein the clamp assembly includes a piston cylinder connected to the length adjustment member, and wherein the clamp is connected to a movable piston of the piston cylinder.

7. The sheet material wrapping device according to claim 1, comprising a conveying unit adapted to receive sheet material from a sheet material source, the conveying unit comprising a feed controller that controls orientation of sheet material received from the sheet material source utilizing a sensor, and adjusts the sheet material orientation if the sensor determines the sheet material is out of alignment.

8. The sheet material wrapping device according to claim 7, wherein the conveying unit includes at least three tension members disposed adjacent a guide roller for selectively applying pressure to one or more portions of the sheet material between one or more of the tension members and the guide roller in order to control orientation of the sheet material, wherein a central tension member maintains the predetermined tension between the central tension member and guide roller, and wherein pressure is applied to one or more of the other tension members selectively to control sheet material orientation.

9. The sheet material wrapping device according to claim 8, wherein the wrapping device further includes a bonding agent application device adapted to selectively apply an adhesive to the sheet material, and wherein the bonding agent application device is located downstream from the conveying unit and upstream from the forming unit.

10. The sheet material wrapping device according to claim 9, wherein the bonding agent application device includes an applicator having a surface adapted to have a bonding agent thereon provided by a bonding agent supply source and capable of applying the bonding agent to the sheet material when in contact with the applicator, and wherein the bonding agent application device further includes one or more lifters movable between at least two positions wherein in a first position the lifter allows the applicator to contact the sheet material and in a second position the lifter prevents the applicator from coming into contact with the sheet material to prevent the bonding agent from being applied to the sheet material.

11. The sheet material wrapping device according to claim 10, wherein the applicator is an elongated roller having at least one recess that houses a portion of one of the lifters in an inactive position.

12. The sheet material wrapping device according to claim 1, wherein the holding member device includes a securing device adapted to temporarily extend through the sheet material in order to secure the sheet material to the holding member.

13. The sheet material wrapping device according to claim 1, comprising a transfer station comprising a platform movable from an inactive position to an active position adapted to support a formed support member during withdrawal of the winding arms from the support member, wherein the transfer station further includes a transfer arm that is adapted to move the support arm off of the platform when returned to an inactive position after the platform has received the support member from the support arms, and wherein the transfer arm moves the support member to a press unit.

14. The sheet material wrapping device according to claim 13, wherein the press unit includes a base plate and a pressure plate adapted to apply a predetermined pressure to the support member.

* * * * *